US006709549B2

(12) United States Patent
Berglund et al.

(10) Patent No.: US 6,709,549 B2
(45) Date of Patent: Mar. 23, 2004

(54) MULTI-REEL APPARATUS IN A PAPER MACHINE

(75) Inventors: C. Magnus Berglund, Karlstad (SE); Anders Tommy Lindén, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/821,290

(22) Filed: Mar. 29, 2001

(65) Prior Publication Data

US 2002/0139499 A1 Oct. 3, 2002

(51) Int. Cl.[7] ..... B65H 67/00

(52) U.S. Cl. ..... 162/118; 162/120; 162/283; 162/286; 242/533

(58) Field of Search ..... 162/118, 120, 162/283, 286; 242/533.04, 533, 533.03

(56) References Cited

U.S. PATENT DOCUMENTS

| | | | | |
|---|---|---|---|---|
| 5,591,309 A | | 1/1997 | Rugowski et al. | |
| 5,732,901 A | * | 3/1998 | McNeil et al. | 242/533.4 |
| 5,901,918 A | | 5/1999 | Klerelid et al. | |
| 6,045,085 A | | 4/2000 | Andersson et al. | |
| 6,176,449 B1 | | 1/2001 | Cramer | |
| 6,183,601 B1 | | 2/2001 | Otto et al. | |
| 6,406,417 B1 | | 6/2002 | Frohlich | |

FOREIGN PATENT DOCUMENTS

| | | |
|---|---|---|
| EP | 0 658 504 | 6/1995 |

OTHER PUBLICATIONS

Copy of International Search Report for PCT/SE02/00483 completed Jul. 10, 2002.

* cited by examiner

*Primary Examiner*—Peter Chin
(74) *Attorney, Agent, or Firm*—Alston & Bird LLP

(57) ABSTRACT

A multi-reel apparatus for use in a drying section of a papermaking machine allows a web to be continuously wound without interruption. The apparatus includes a web support and a pair of vertically stacked reeling stations located along an inclined portion of the web support. Each reeling station has at least one reeling device operable to hold and rotatably drive a core onto which the web can wound to form a roll. Each reeling device is further operable to move the core into engagement with the web on the web support to initiate winding of the web onto the core, and to move the core away from the web support when the roll is fully wound. Winding is alternated between reeling devices, allowing the completed roll to be removed and a new core to be loaded at one reeling station while the other reeling station continues in full winding operation.

48 Claims, 14 Drawing Sheets

MULTI-REEL APPARATUS IN A PAPER MACHINE

FIELD OF THE INVENTION

The present invention relates to papermaking machines, and more particularly relates to a method and apparatus for achieving a continuous paper winding process using a number of reel-up stations at different locations along a travelling paper web path wherein one station is always prepared to commence winding upon completion of the paper roll at another station.

BACKGROUND OF THE INVENTION

In the manufacture of various types of tissue products, such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

In a conventional dry end of a papermaking machine, the dried web is wound into rolls by the reel-up. The conventional reel-up includes a rotating reel shaft held by a pair of primary arms against a reeling drum to form a nip. The free end of the continuous paper web, in the form of a leader, is introduced into the nip. The paper web is adhered to the reel shaft by a vacuum tape or glue and winds onto the reel shaft as it is advanced into the nip to form a roll. Once partially wound, the primary arms transfer the roll to a set of secondary arms which complete the winding process. After the roll is completed, the continuous paper web is severed, the downstream portion of the web becoming the tail end that is wound onto the completed roll and the upstream portion becoming the new leader.

Completion of the roll frees the apparatus to receive a new reel shaft. A pair of lowering arms, positioned above the primary arms and the reeling drum, retrieve a new reel shaft from a stock of reel shafts and lower the new reel shaft into the primary arms. The primary arms grippingly receive the new reel shaft and hold the new reel shaft against the reeling drum to form the nip. The new leader is advanced into the nip to begin a new roll.

Reel changing methods are commonly assisted by balloon blowing. Balloon blowing entails creating slack across the full width of the paper by somewhat retarding the finished roll. With the aid of compressed air, the fold thus formed is then forced into the nip between the new reel shaft and the reel drum, after which the paper web is cut off. The degree of control over the paper web in the balloon blowing procedure is relatively low because the web is not supported on any support in the ballooned portion of the web. This lack of control can lead to problems.

U.S. Pat. No. 5,901,918 to Klerelid et al. ('918) addresses this lack of control by providing support for the paper web during reel switching. The apparatus disclosed by the '918 patent includes a reel-up having a fabric run defined by a flexible transfer belt spanning two support rolls. The flexible transfer belt supports and advances the paper web. The web is transferred from the transfer belt to a parent roll as the parent roll is urged against one portion of the flexible belt. Reel switching occurs when a new reel spool is lowered into an initial winding position against the web on another portion of the belt. No balloon blowing is used and the paper web is continuously supported. However, arms are required to lower the new reel spool into the initial winding position, and the new reel spool must be moved along the transfer belt from the initial winding position into a final winding position as winding proceeds. This movement of the building paper roll complicates the control of the nip load.

Another disadvantage of reel switching is the production down time associated with the reel switching process. The production of large jumbo rolls minimizes the frequency of reel switching. However, jumbo rolls are even more difficult to wind and handle due to their size and weight. The winding process typically starts when a core is brought into contact with a reel drum supporting the paper web. Controlling the linear load in the paper web at the nip during initiation of the winding process is made more difficult by the heavy core shafts of the jumbo rolls. These difficulties continue as the roll is wound and its weight increases, because the tissue paper web is fragile and sensitive to the nip pressure. Conventional reel-ups require a complicated control system to control the linear load and meet requirements for tissue web quality when winding jumbo rolls. Manufacturing losses from these difficulties occur because the failure to control linear load often results in 200 to 300 meters of tissue paper web at the beginning of the jumbo roll not being of commercial quality.

Therefore, it would be advantageous to have a reeling apparatus that always supports the paper web and that minimizes any delay caused by the reel switching process. It would be further advantageous to have a reeling apparatus that produced smaller rolls without additional production down time.

SUMMARY OF THE INVENTION

These and other needs are met by the multi-reel apparatus according to the present invention. The present invention avoids problems with web instability by supporting the paper web along its entire path through the apparatus. Delays in parent roll production are reduced by alternating between multiple reeling apparatuses so that any one apparatus is winding paper web onto a parent roll while the others are swapping a completed parent roll for a new empty reel shaft. The reduction in down time due to reel switching allows for the production of small rolls which are easier to wind and handle.

A paper web manufacturing machine includes a wet section having a former for forming a wet web, a drying section for drying the wet web, and the multi-reel apparatus for winding the dried web into completed rolls. The multi-reel apparatus includes a web support which supports the travelling web along a path of travel that extends from a first vertical level to a second vertical level, wherein the two levels are vertically spaced. First and second reeling stations are located, respectively, at the first and second vertical levels. Each reeling station has a reeling device operable to hold and rotatably drive a core onto which the web is wound to form a roll. The reeling devices are further operable to move the core into engagement with the web on the web support thereby initiating winding of the web onto the core. The reeling devices are also operable to move the core away from the web support when the roll is fully wound so that the web can begin winding onto the core held in the reeling device of the other reeling station. In this manner, the web is continuously wound alternately in one reeling station and then in the other reeling station. This increases the efficiency of the papermaking process by eliminating the down-time during reel switching.

In another embodiment, the continuous web prior to winding is divided into two partial-width web portions. Each reeling station includes two reeling devices spaced in the width direction of the web for the simultaneous winding of the two web portions. The continuous web is alternately wound in the two reeling devices of the first reeling station and then in the second reeling station. The partial-width web portions are advantageously wound onto separate cores and shafts at each station to form small rolls that are easily manipulated in additional downstream processing. The small rolls generally have lighter cores and shafts, and can even use composite based shaftless cores for an additional reduction in weight and an increase in reeling speed.

In yet another embodiment, the partial-width web portions are simultaneously wound in the first and second reeling stations into small rolls. Each reeling station includes first and second reeling devices that are vertically stacked whereby each web portion is continuously wound alternately in the first and then the second reeling devices of each reeling station.

Initiation of a new roll preferably is aided by a cutting device operable to sever the web when the roll in one of the reeling stations is completed so that the other reeling station can begin to wind the web onto its core. The cutting device may be combined with an adhesive applicator positioned adjacent to the path of travel of the web and upstream of the reeling stations. A signal triggers the adhesive applicator to apply adhesive to the web and the cutting device cuts the web so that the cut is downstream of the applied adhesive.

The web support in some embodiments comprises an endless carrying clothing guided along the path of travel by a plurality of rolls about which the clothing is looped. This clothing may be a through-air drying fabric on which the web is dried in the drying section, or it may be a separate clothing that receives the web from the drying section. Alternatively, the web support may comprise a foil or plurality of foils for supporting the web thereon.

The multi-reel apparatus has several advantages. The elimination of down time for reel switching allows for continuous paper web production and the cost-effective production of small rolls in place of jumbo rolls. Small, relatively light rolls reduce winding and downstream handling problems associated with heavy jumbo rolls. Lighter reel shafts used in smaller rolls are more easily controlled by the reeling device to maintain proper web tension and nip load for high quality tissue paper web production. In addition, the multi-reel apparatus does not require lowering arms or any mechanisms for moving a new reel shaft on which winding is commencing from an initial winding position into a final winding position previously occupied by the prior-wound roll. This further improves the simplicity of operation as well as the control of the nip load.

BRIEF DESCRIPTION OF THE DRAWINGS

Figure 1:
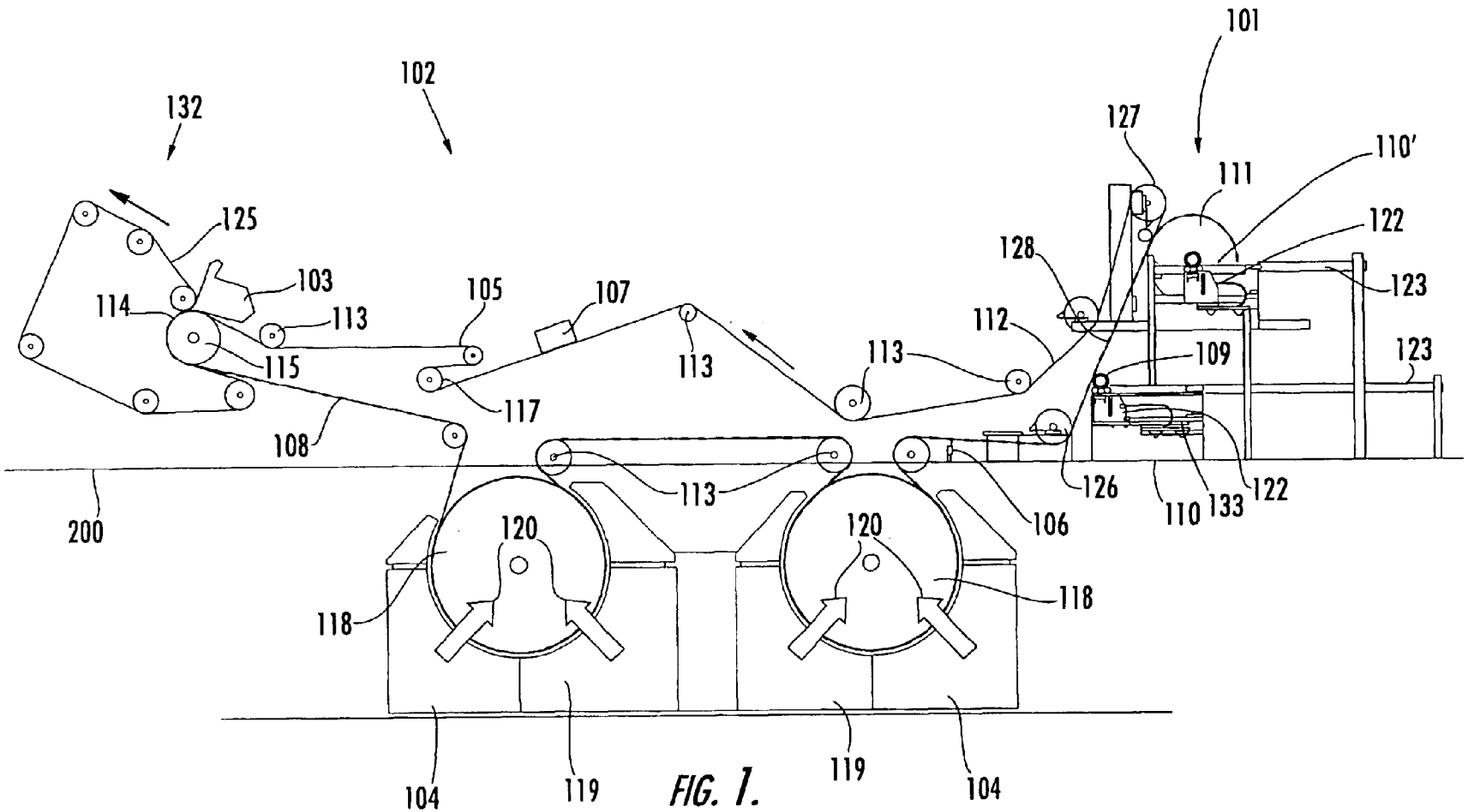
Figure 5:
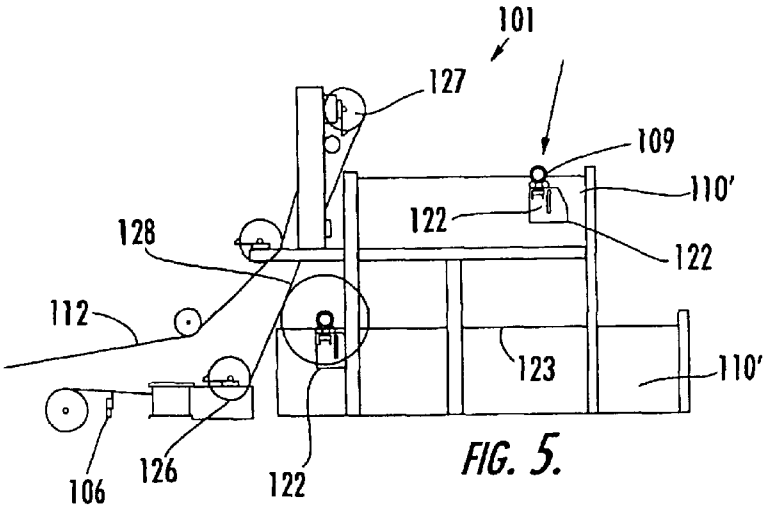
Figure 2:
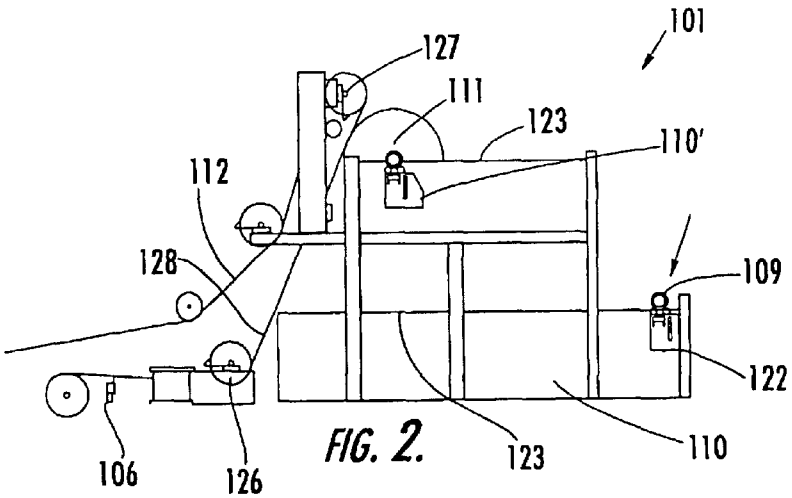
Figure 4:
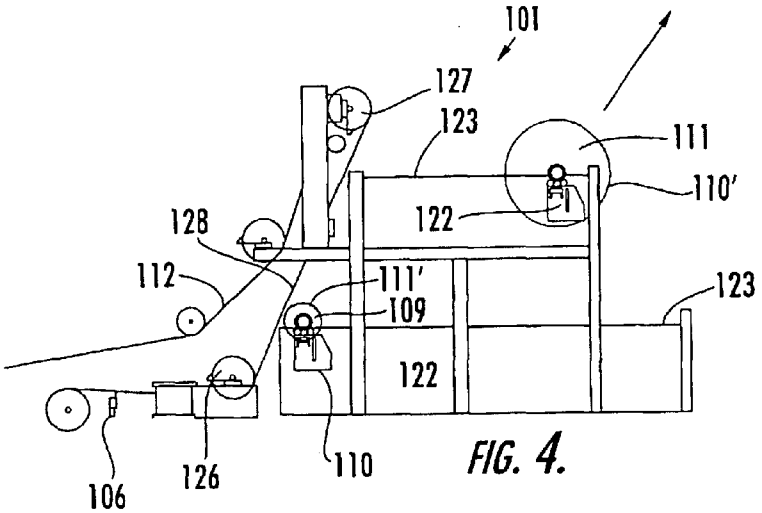
Figure 3:
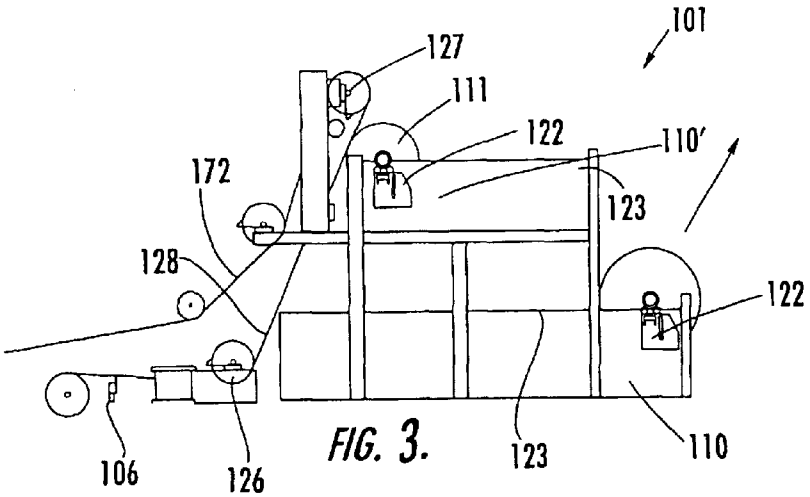
Figure 8:
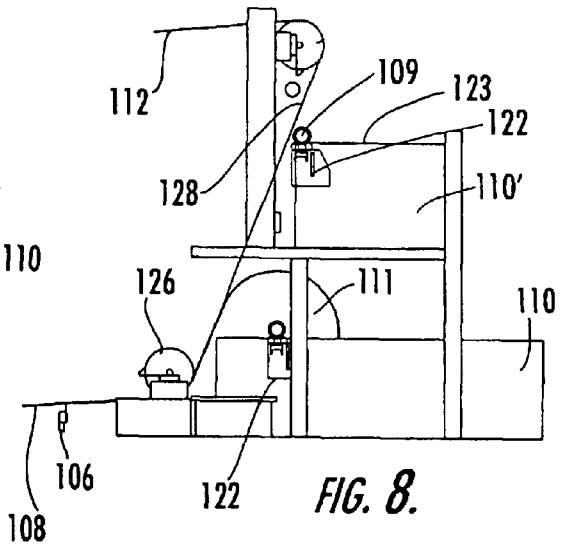
Figure 7:
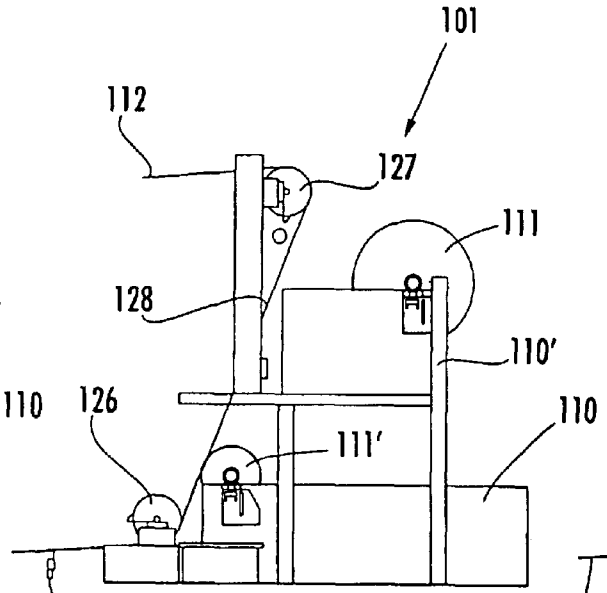
Figure 6:
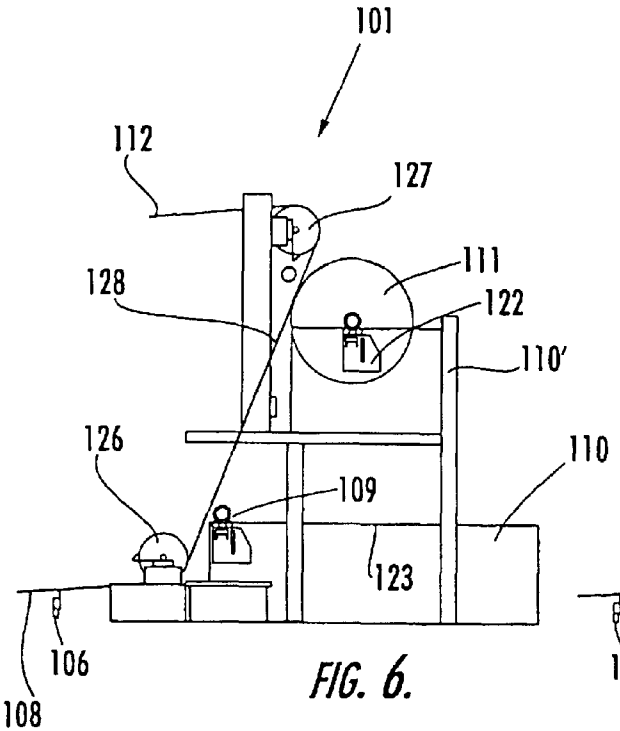
Figures 9, 10, 11:
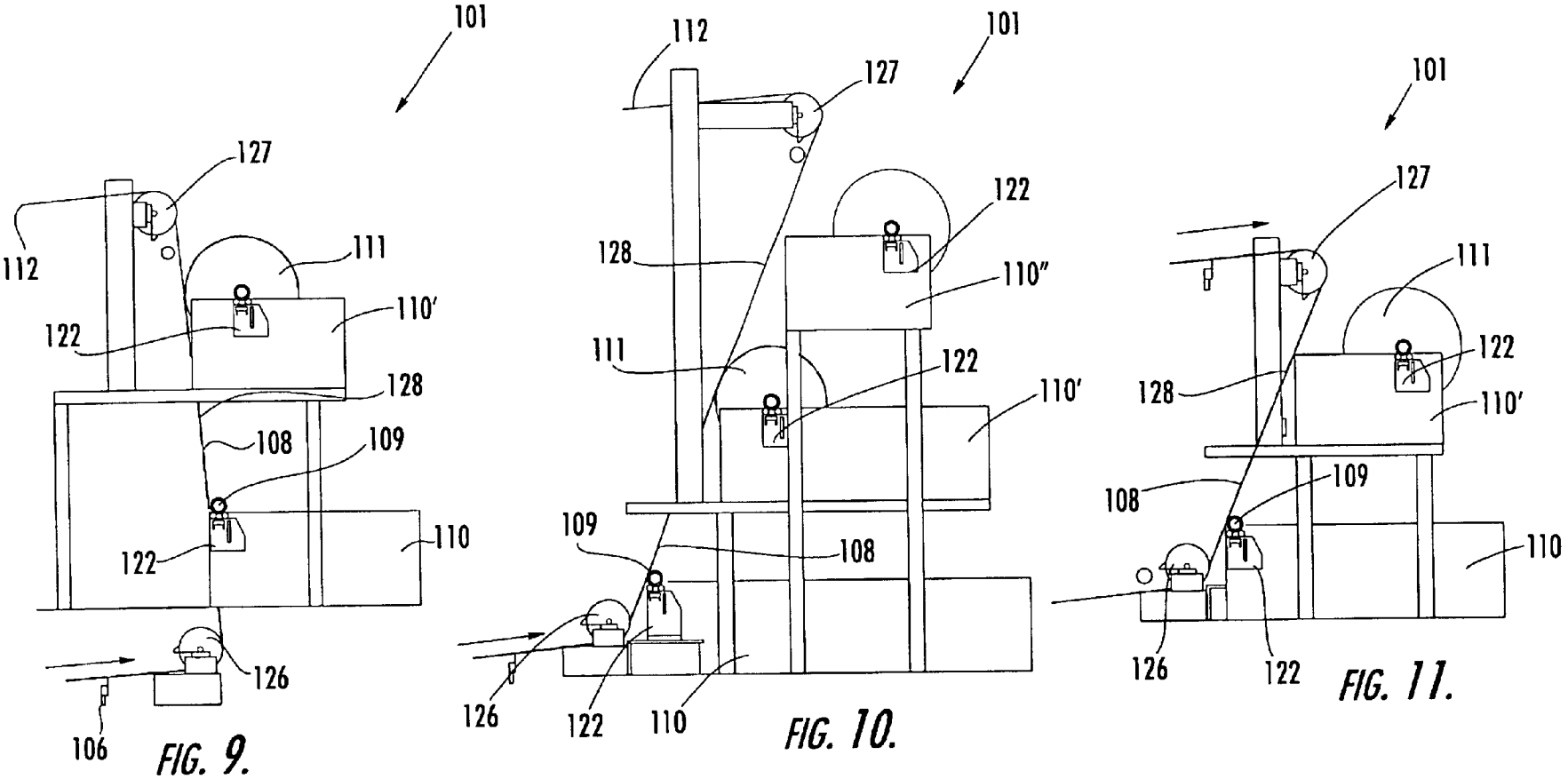
Figure 12:
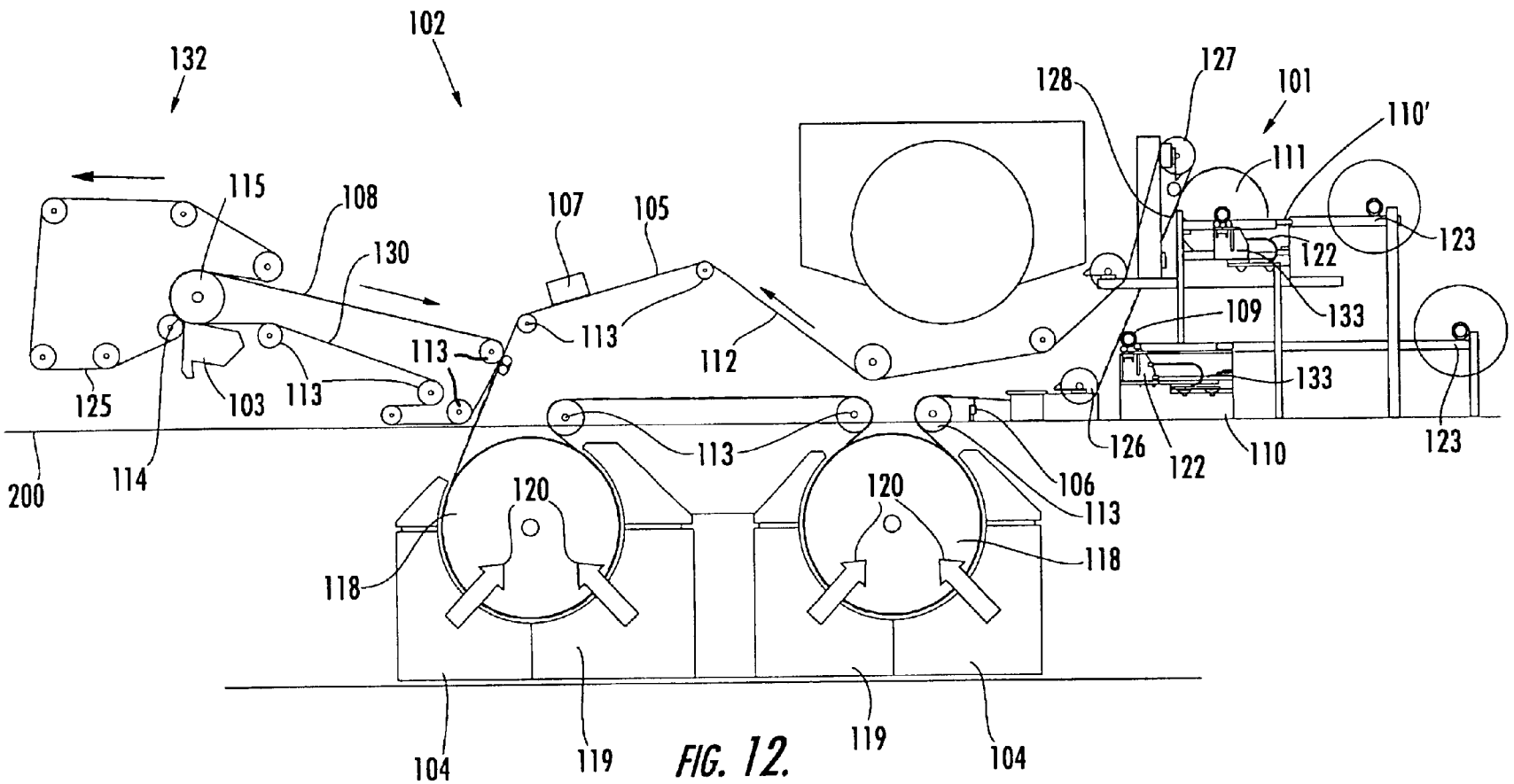
Figure 13:
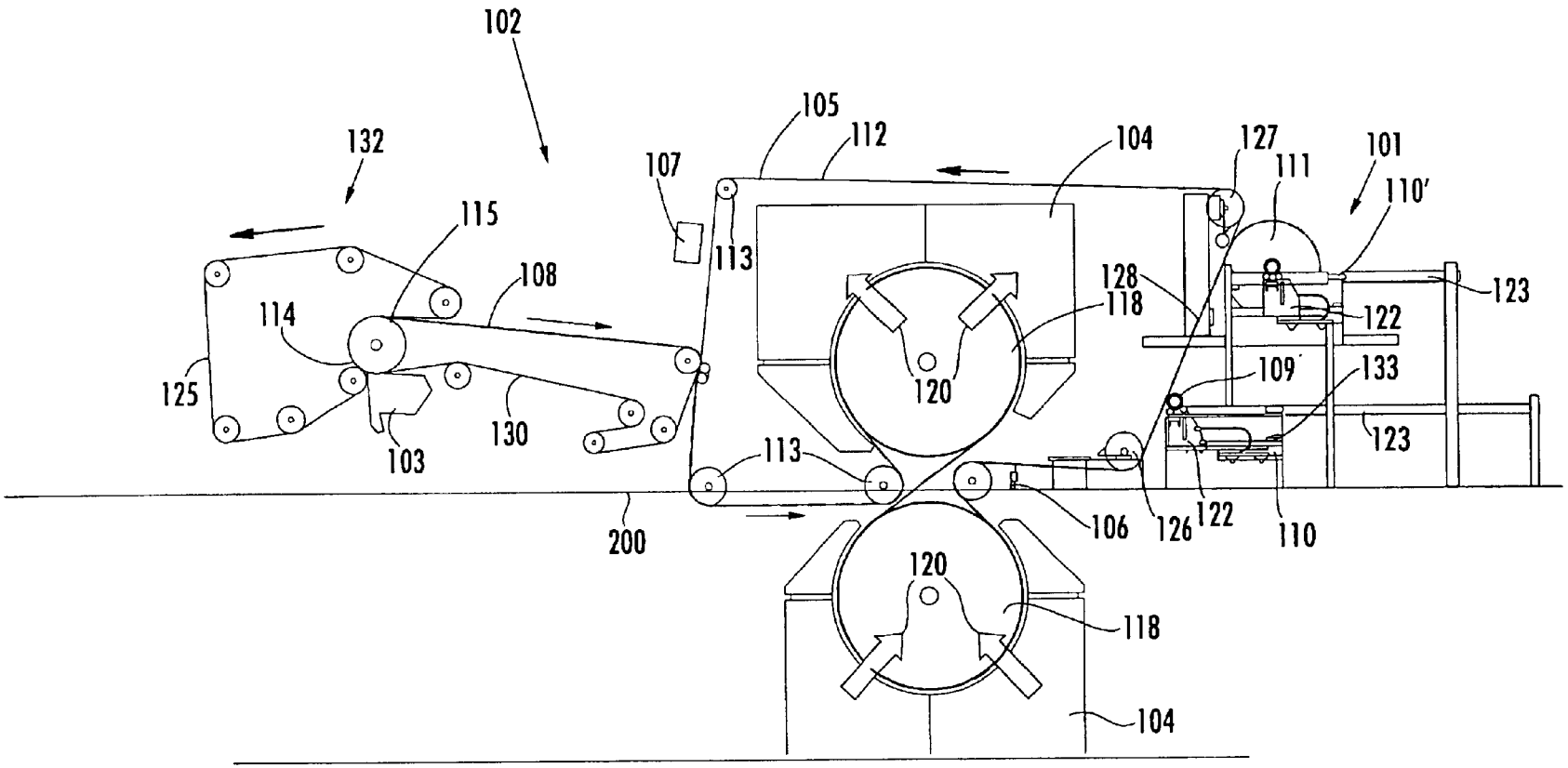
Figure 14:
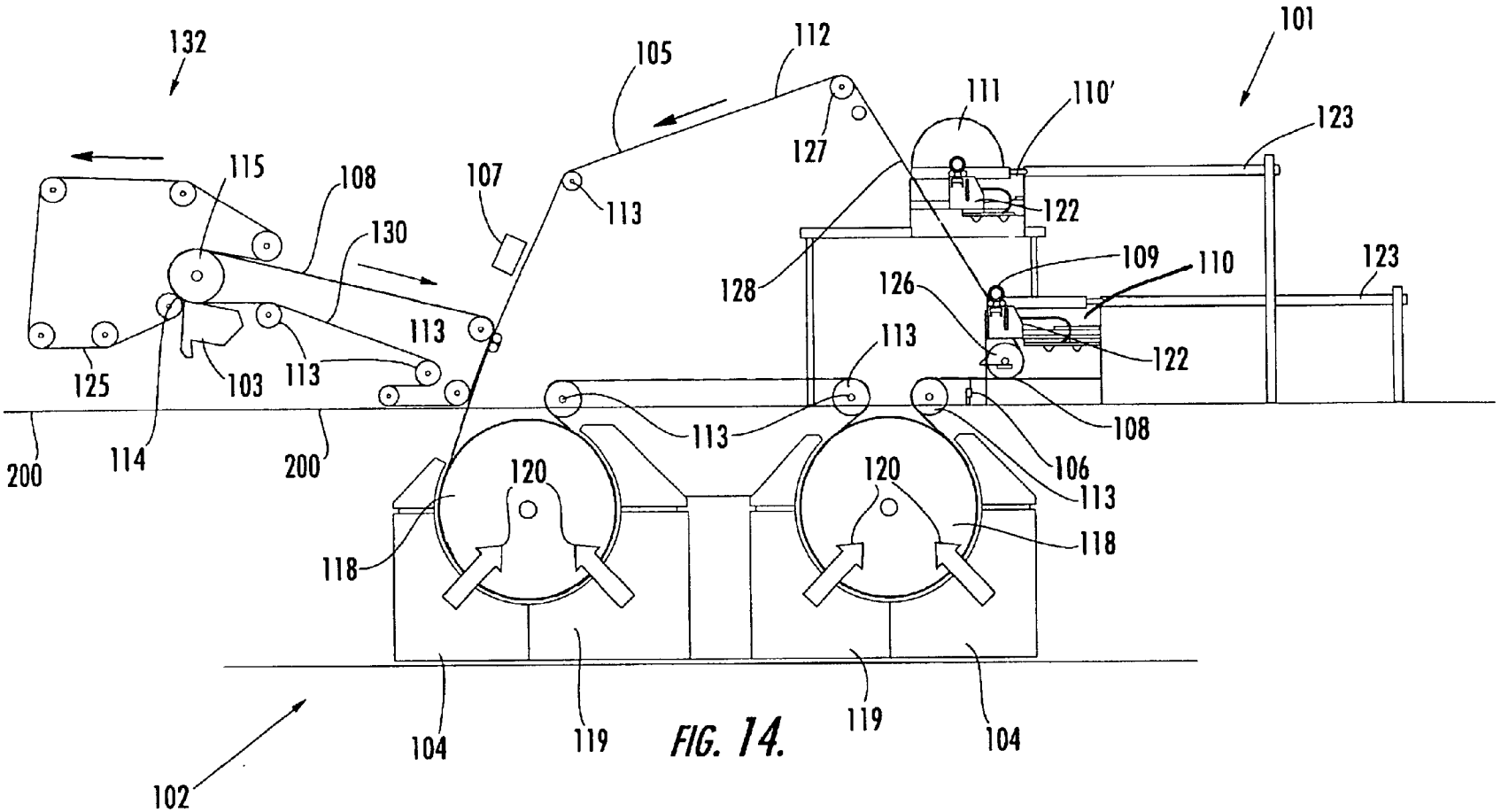
Figure 15:
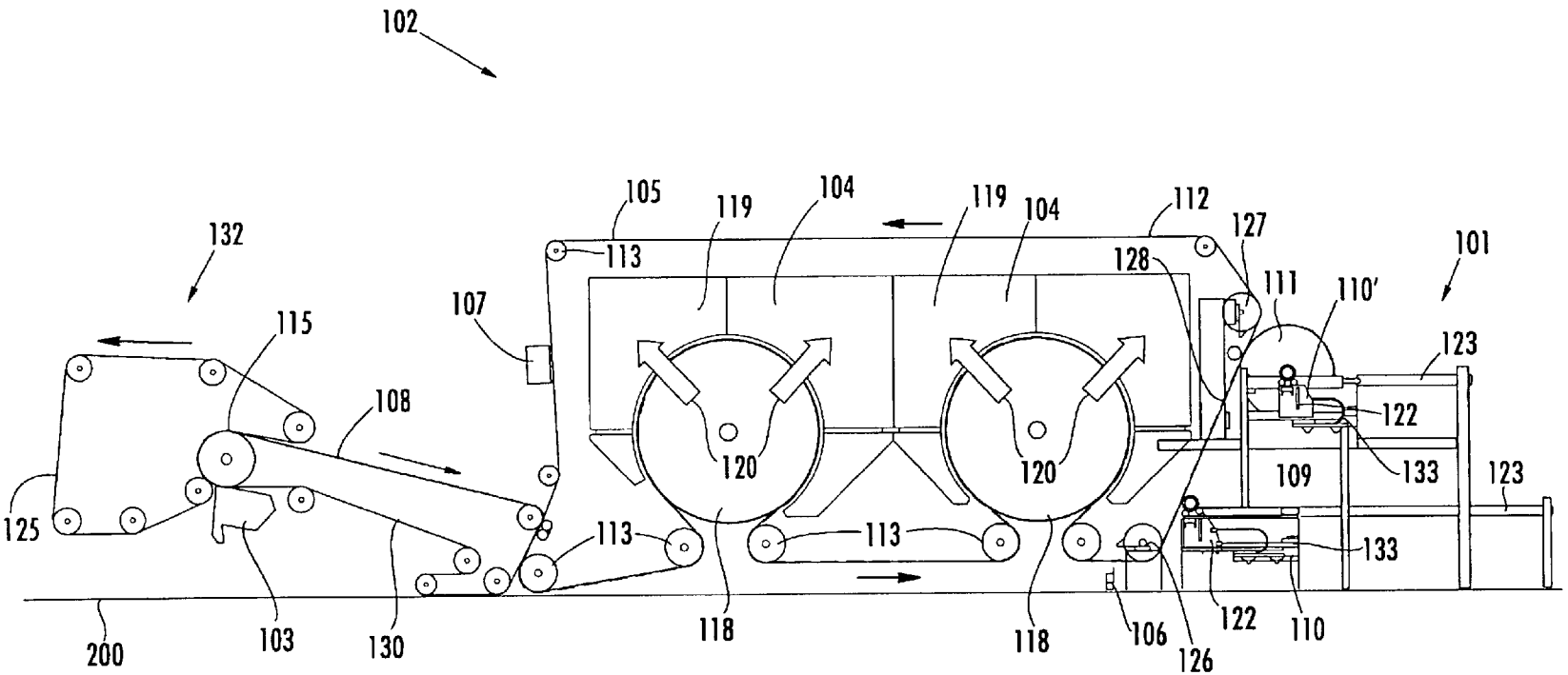
Figure 16:
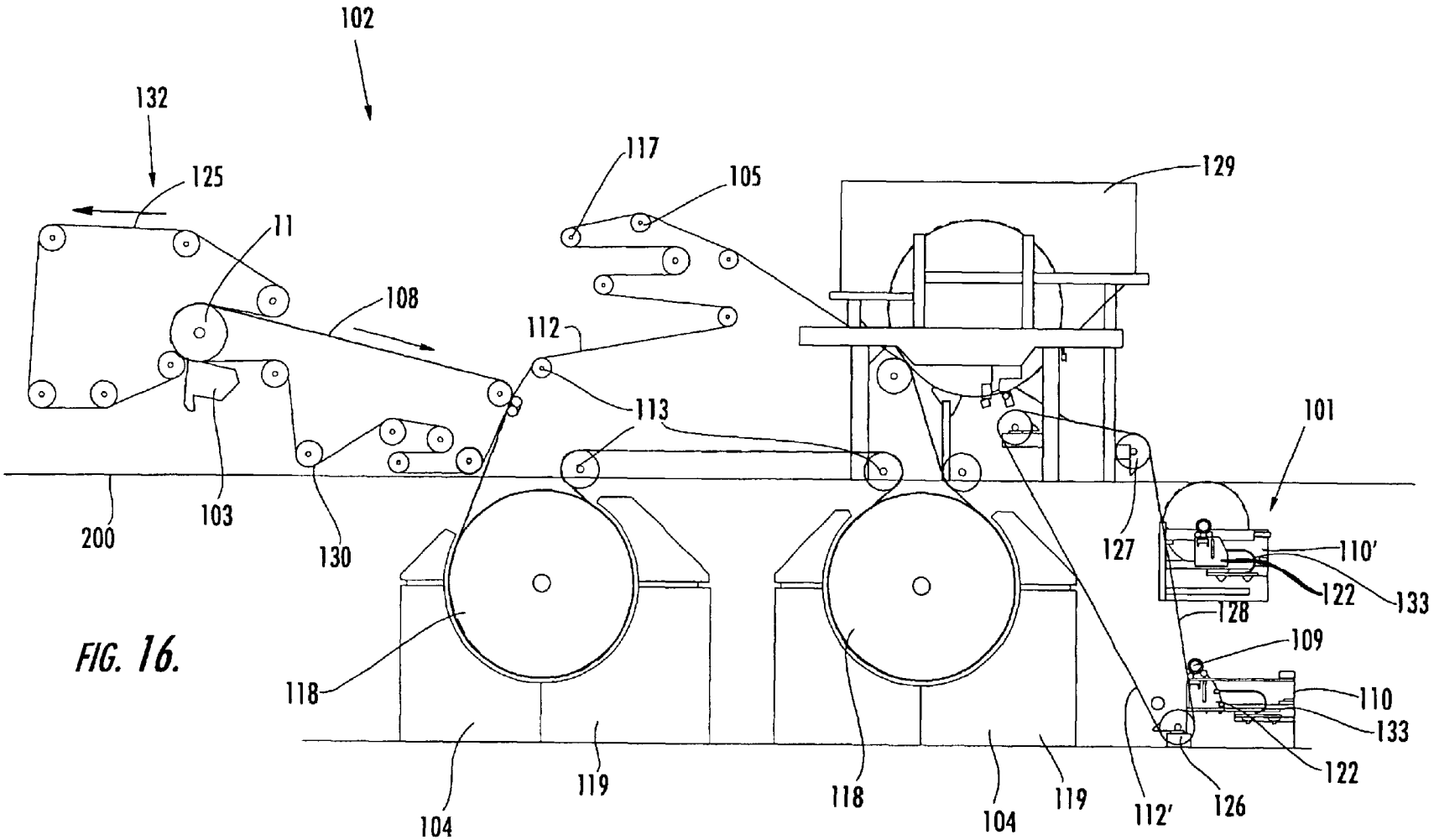
Figure 17:
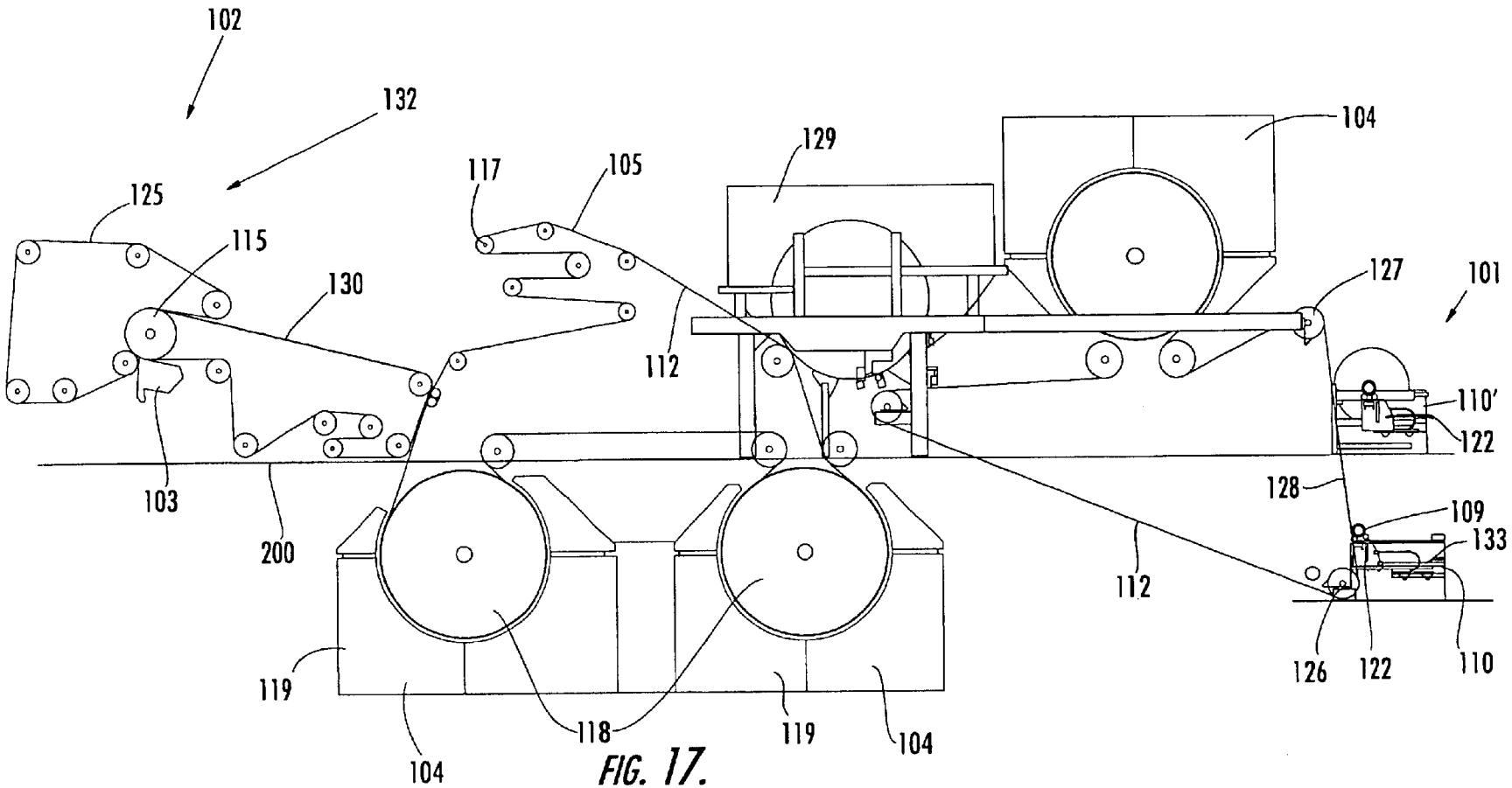
Figure 18:
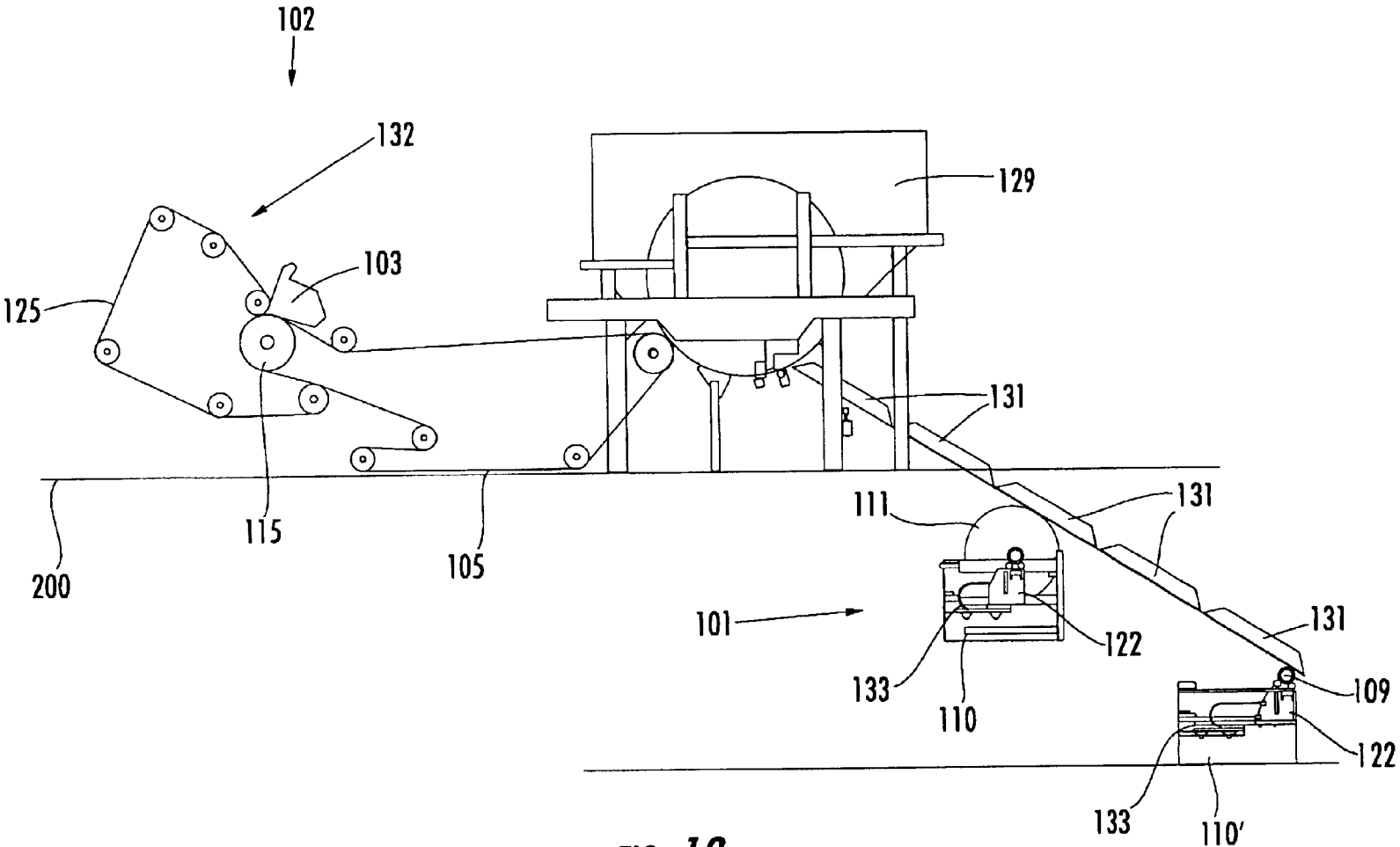
Figure 19:
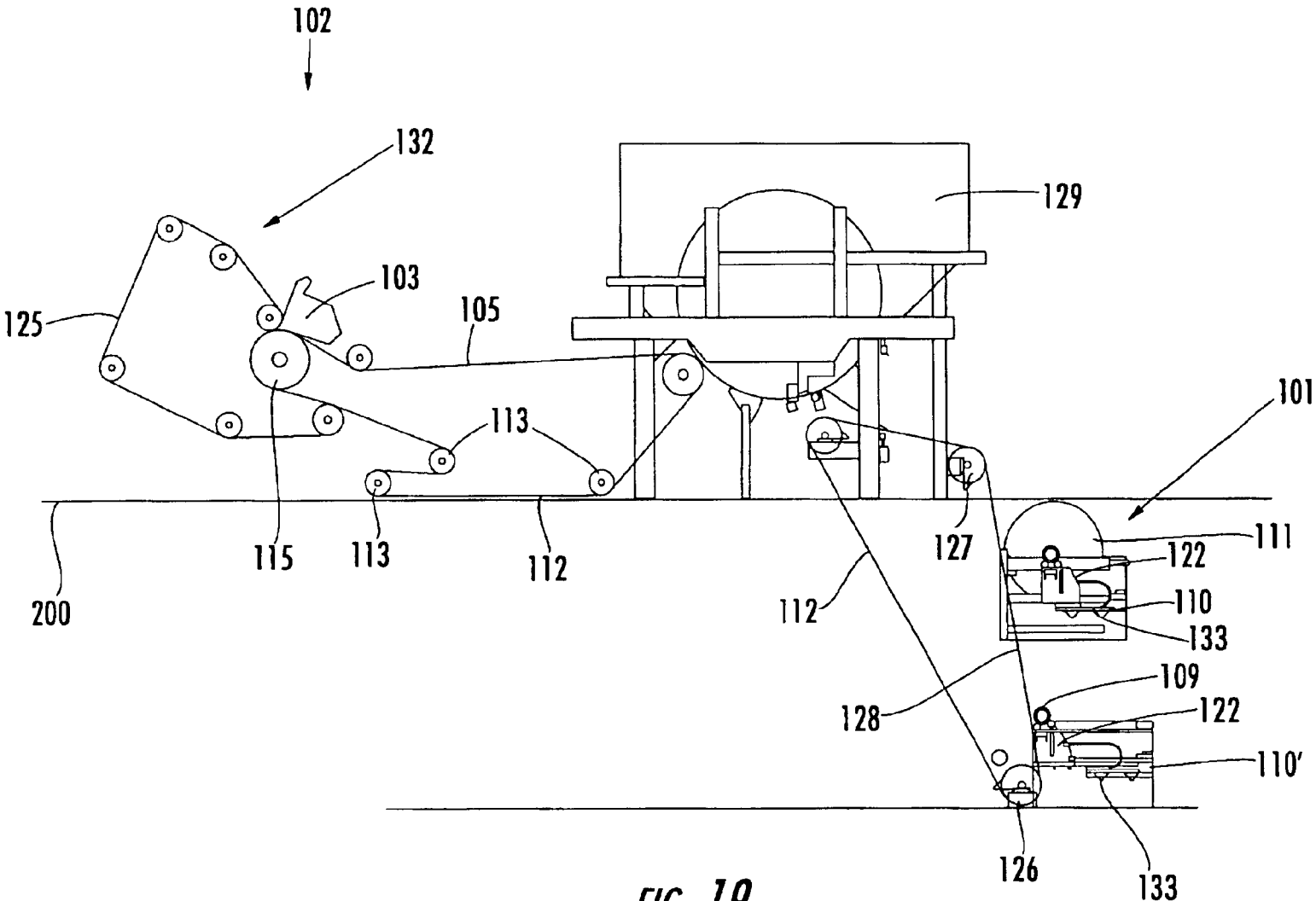
Figure 20B:
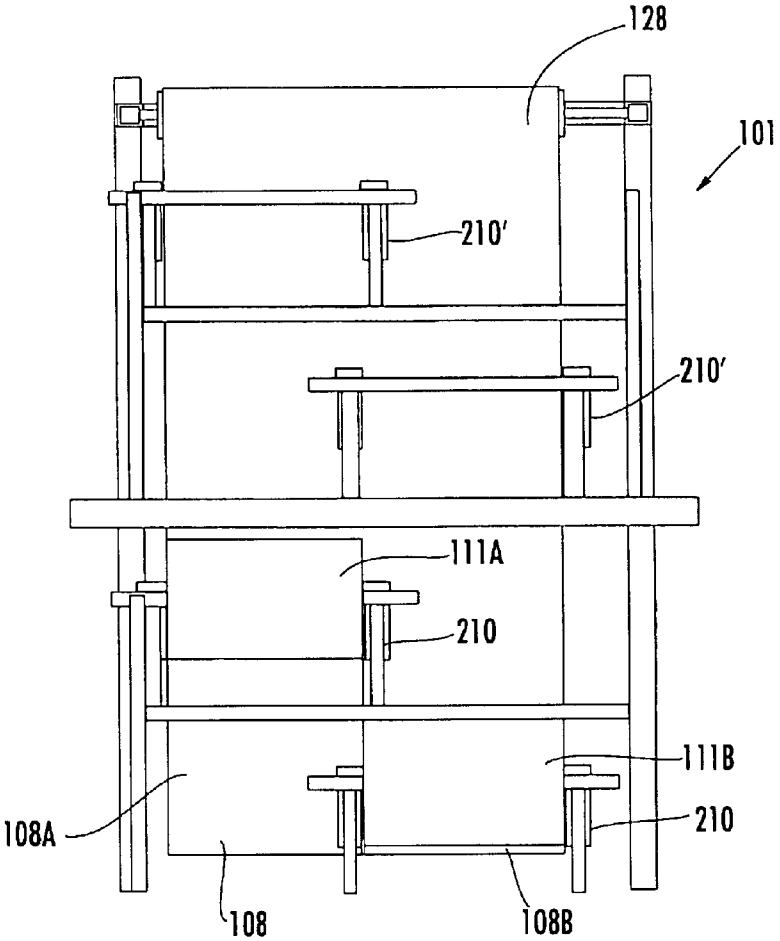
Figure 20A:
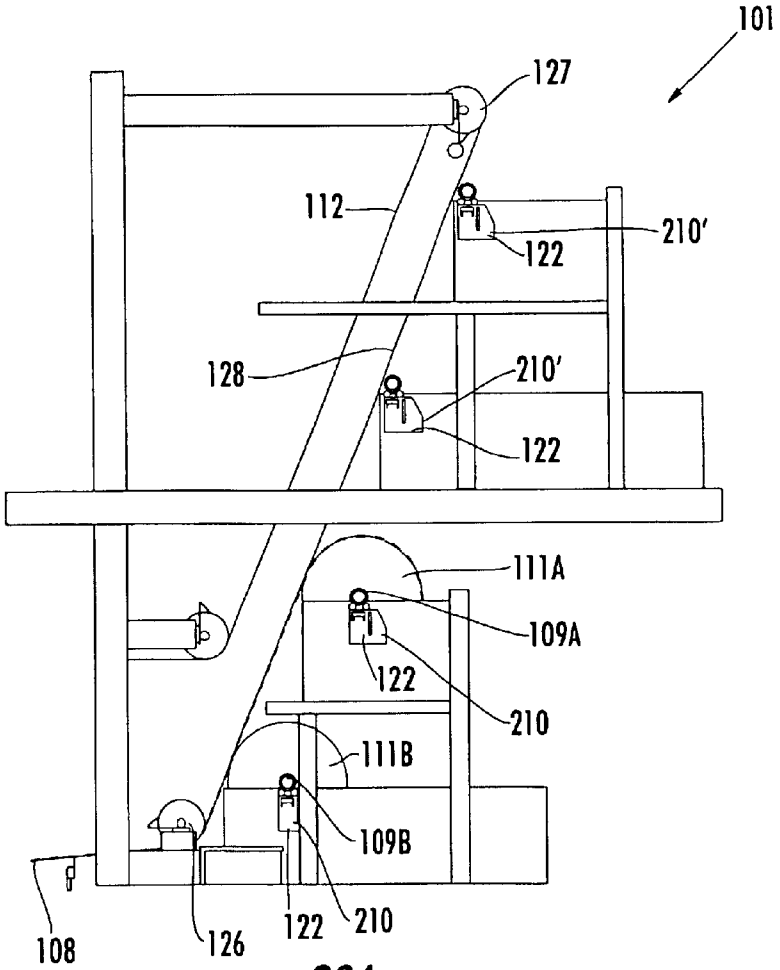
Figure 21B:
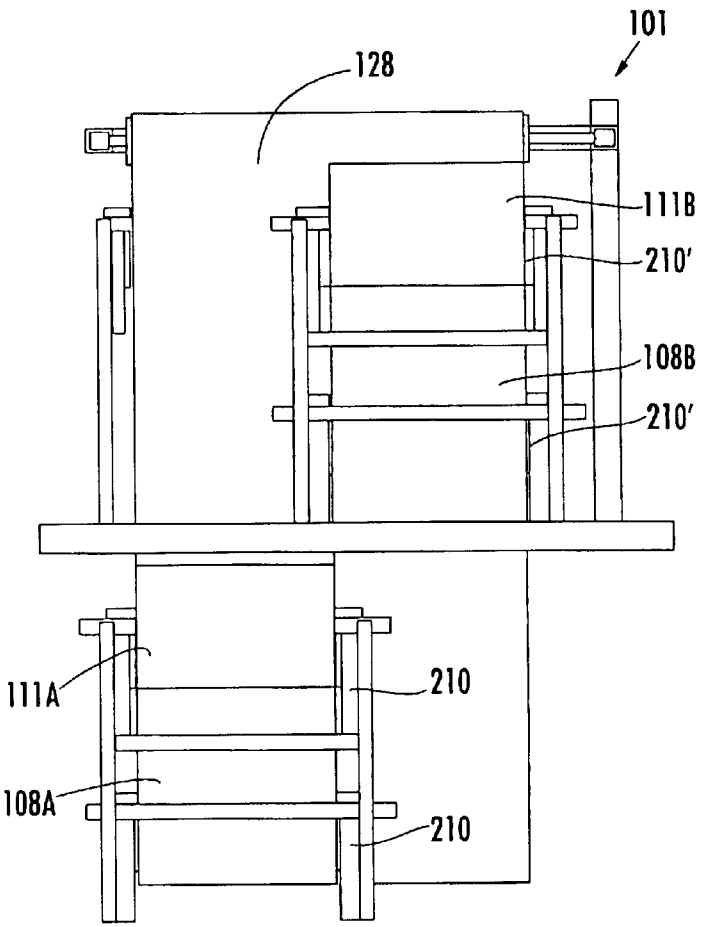
Figure 21A:
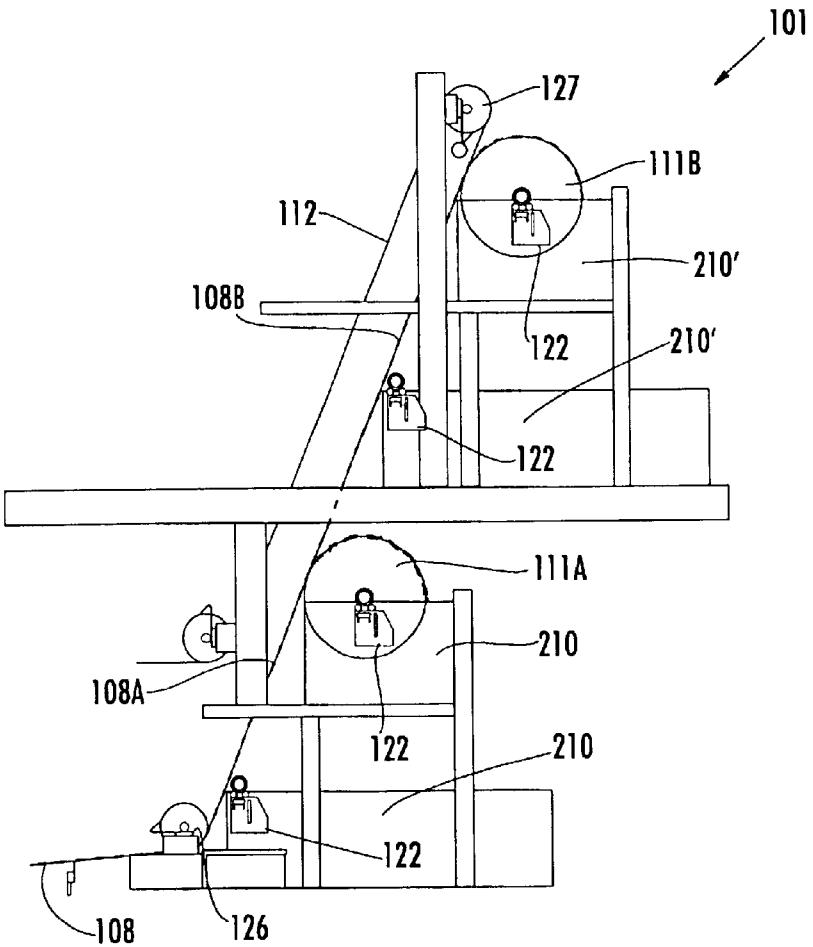

Having thus described the invention in general terms, reference will now be made to the accompanying drawings, which are not necessarily drawn to scale, and wherein:

FIG. 1 is a schematic diagram that depicts a paper machine including a multi-reel apparatus in accordance with the present invention;

FIG. 2 is a schematic diagram of the multi-reel apparatus shown in FIG. 1 that depicts core replacement at the first reeling station;

FIG. 3 is a schematic diagram of the multi-reel apparatus shown in FIG. 1 that depicts the completed parent roll positioned for lift-off at the first reeling station;

FIG. 4 is a schematic diagram of the multi-reel apparatus shown in FIG. 1 that depicts the initial winding of a new roll at the first reeling station during removal of a completed parent roll at the second reeling station;

FIG. 5 is a schematic diagram of the multi-reel apparatus shown in FIG. 1 that depicts core replacement at the second reeling station;

FIG. 6 is a schematic diagram of a multi-reel apparatus that depicts switching between winding at a second reeling station to winding at a first reeling station;

FIG. 7 is a schematic diagram of the multi-reel apparatus shown in FIG. 6 that depicts placement of a new core at the second reeling station during winding of the parent roll at the first reeling station;

FIG. 8 is a schematic diagram of the multi-reel apparatus shown in FIG. 6 that depicts switching between winding at the first reeling station to winding at the second reeling station;

FIG. 9 is a schematic diagram that depicts a backward leaning multi-reel apparatus;

FIG. 10 is a schematic diagram that depicts a multi-reel apparatus with three reeling stations;

FIG. 11 is a schematic diagram that depicts a multi-reel apparatus wherein the direction of travel of the paper web has been reversed relative to that in FIGS. 1–10;

FIG. 12 is a schematic diagram that depicts a paper web drying section including a Yankee dryer which has been bypassed for rebuilding;

FIG. 13 is a schematic diagram that depicts a paper web drying section including a pair of stacked through-air dryers (TADs);

FIG. 14 is a schematic diagram that depicts a paper web drying section with a shortened layout;

FIG. 15 is a schematic diagram that depicts a paper web drying section with a flat layout;

FIG. 16 is a schematic diagram that depicts a paper web drying section including the combination of a pair of TADs with a Yankee dryer;

FIG. 17 is a schematic diagram that depicts a paper web drying section including a Yankee pre-dryer and a final TAD dryer;

FIG. 18 is a schematic diagram that depicts a paper web drying section including a conventional Yankee dryer and a plurality of foils supporting the paper web;

FIG. 19 is a schematic diagram that depicts a paper web drying section including a Yankee dryer with a dry-end wire for carrying the web from the Yankee to the multi-reel apparatus;

FIG. 20A is a schematic diagram that depicts a multi-reel apparatus wherein each reeling station has a pair of adjacent reeling devices for reeling small rolls;

FIG. 20B is an elevation view of the multi-reel apparatus of FIG. 20A;

FIG. 21A is a schematic diagram that depicts a multi-reel apparatus wherein each reeling station has a pair of vertically stacked reeling devices for reeling small rolls; and FIG. 21B is an elevation view of the multi-reel apparatus of FIG. 21A.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

A first embodiment of a multi-reel apparatus 101 is shown in FIG. 1 as part of a paper machine having a forming section 132 and a drying section 102. FIGS. 2 through 8 depict two embodiments of the multi-reel apparatus 101 during different phases of operation. The forming section 132 includes an inner forming fabric 112, an outer forming fabric 125, a headbox 103, and a forming roll 115. The headbox 103 deposits an aqueous suspension of papermaking fibers between the inner fabric 112 and the outer fabric 125 as they traverse the forming roll 115. The outer forming fabric 125 diverges from the inner forming fabric after the fabrics depart from the forming roll 115. The paper web 108 is then carried on an underside of the inner forming fabric 112.

The inner forming fabric 112 also comprises a drying fabric carrying the web 108 through the drying section 102. More particularly, the paper web 108 is carried on the forming and drying fabric 112 through a pair of through-air dryers (TADs). The TADs 104 each include a drying cylinder 118 partially surrounded by a hood 119 which is connected to a blower (not shown). The fabric 112 with the paper web 108 supported thereon is guided around the pair of drying cylinders 118. The drying cylinders 118 have outer surfaces that are air permeable and allow the passage of air, as shown by arrows 120, through the paper web 108, the fabric 112 and through the drying cylinder's permeable outer surface. The pressure of the air on the paper web 108 secures it against the fabric 112 in opposition to centrifugal forces. The choice of two TADs 104 is not meant to be restrictive, as a single TAD, several TADs, or other drying devices could be used to dry the paper web 108.

The fabric 112 in the current embodiment also supports the web 108 through the multi-reel apparatus 101. Thus, downstream of the TAD units a portion of the loop of fabric 112 travels upwards past a first reeling station having a first reeling device 110 at a first elevation and then past a second reeling station having a second reeling device 110', at a second, higher elevation. The paper web 108 is transferred from the fabric 112 to whichever reeling device 110 or 110' is currently winding the web onto a core 109. A more detailed description of the multi-reeling apparatus 101 appears below.

Many advantages of the current invention will be apparent from a detailed description of the multi-reel apparatus 101. The multi-reel apparatus includes the first reeling device 110 and the second reeling device 110' positioned at different vertical levels along a portion of the loop of the forming and drying fabric 112, allowing continuous winding of the paper web 108 because one of the pair of reeling devices is engaged with the web support assembly at all times. The pair of reeling devices 110 and 110' alternate between winding and core switching roles, as shown in FIGS. 2 through 5, to prevent interruption of the winding process.

Each reeling device 110, 110' includes a pair of carriages 122 each of which slides along one or more carriage rails 123 toward and away from the fabric 112 and is configured to support one of the cores 109 in a position proximate a pair of paper roll support rails 123. The pair of rails 123 for the second reeling device 110' are mounted at a greater height than those for the first reeling device 110. The difference in vertical height places the carriage 122 of the first reeling device 110 further upstream along the fabric 112 than the carriage 122 of the second reeling device 110'. Each carriage 122 is driven toward and away from the fabric 112 along the rails 133 by a hydraulic actuator (not shown). Two guide rolls 126 and 127 bracket a fabric run 128 of the fabric 112 that extends above and below the first and second reeling devices.

The web 108 is supported by the fabric 112 along the fabric run 128 between the two support rolls 126 and 127 and is wound onto a roll 111 rotatably supported by one of the reeling devices. The core 109 can be moved toward and away from the fabric 112 by the carriage 122. As the parent roll 111 builds, the core 109 is continually moved away from the fabric to compensate for the increasing diameter of the roll. Movement of the carriage 122 can also be controlled to control a nip load between the paper roll and the fabric 112. One suitable method for controlling nip load in this fashion is described in U.S. Pat. No. 5,901,918, hereby incorporated herein by reference.

Continuous winding is achieved by alternating reel-up operation between the first and second reeling devices 110 and 110'. FIGS. 2 and 3 show the second reeling device 110' having completed a parent roll 111 and ready for switching. The switching process is aided by the tail cutter 106 which includes two nozzles, one to spray a water jet, and another to spray a glue jet, across a transverse section of the traveling web 108. Once the parent roll 111 is near completion, the controller signals the tail cutter 106 to cut a section of the paper web 108 transverse to its direction of travel using the water jet. Simultaneously, or shortly thereafter, the glue nozzle sprays a glue jet slightly upstream from the severed edge of the paper web 108. Advantageously, the water and glue nozzles are mounted for traversal in a cross-machine direction along the width of the paper web 108 and preferably can be mounted in the same traversing mechanism (not shown).

The first reeling device 110 advances a new core 109 into contact with the paper web 108 on the fabric 112 before the glue line is applied to the paper web 108 or before the glue line reaches the first reeling device. At the same general time, the second reeling device 110' moves the nearly completed parent roll 111 away from the fabric 112. As the paper web 108 continues to advance, the portion of the paper web downstream of the cut becomes the tail end of the current parent roll 111. This downstream portion continues to be wound to completion on that parent roll by the second reeling device 110'. The portion of the paper web upstream of the cut, containing the glue line, advances along the fabric 112 until it encounters the outside surface of the core 109 that is currently held by the first reeling device 110. The glue line causes the upstream portion of the paper web to adhere to the core 109 of the second reeling device 110', thereby beginning a new parent roll 111', as shown in FIG. 4.

The completed parent roll 111 at the second reeling device 110' is preferably rolled along the guide rails 123 by the carriage 122 to a pick-up location, keeping the movement and position of the roll under control. Alternatively, the roll 111 could be kicked off the carriage to roll along the guide rails 123. The completed parent roll 111 can be lifted from the rails 123 in any suitable manner (e.g., by using a traversing crane) for further distribution.

As shown in FIG. 5, the situation has reversed itself in that a new core 109 is being advanced into a position in contact with the fabric 112 at the second reeling device 110'. The new core 109 is loaded onto the carriage 122 of the second reeling device 110' and advanced toward the fabric 112. Meanwhile, the first reeling device 110 continues winding of the core 109 into a parent roll 111 using the first reeling device 110. Once the parent roll 111 approaches completion on the first reeling device 110, the tail cutter 106 is triggered (as shown for another embodiment in FIG. 8). The paper web 108 is cut and glued by the tail cutter 106 with the downstream portion becoming the tail end of the parent roll 111 at the first reeling device 110 and the upstream portion (with the glue line) adhering to the core 109 held by the second reeling device 110'. Before wind-up at the second reeling device 110' commences, the first reeling device 110 has performed its kick-off operation. In this manner, the multi-reel apparatus 101 can continue the winding process indefinitely and without interruption. No delay is encountered while switching out completed rolls for new cores. Furthermore, the paper web at all times is supported on the fabric 112 during winding.

Note that variations are possible for the commencement of a new roll 111' beyond the use of the tail cutter 106. In one embodiment, the web 108 is severed by kicking the fully wound roll away from the fabric 112 to cause a rapidly imposed tensile force on the web. One or more air jets serve to blow the paper web back toward the new core after it has been severed by the kick-out procedure. The paper web is then captured by vacuum suction from within the core. In another embodiment, glue could be applied directly to the new core so that contact with the paper web commences reel-up and simultaneously tears the web thereby allowing completion of the old parent roll.

A range of other embodiments of the multi-reel apparatus 101 are also possible. The flexibility inherent in the multi-reel 101 invention is important due to the fact that in many situations it may be retrofit to a preexisting paper machine. Paper machines are often custom built to meet the user's desired paper type and quality. In addition, each user is operating under unique space and cost constraints that will, in part, dictate the layout of the paper machine (such as whether portions of the machine are above or below a main floor 200). Existing machines can have any number of dryers in varying arrangements and still benefit from continuous winding as performed by the multi-reel 101. The following description of alternative embodiments is only intended to be demonstrative of the flexibility of this invention and not limiting in any way.

FIGS. 6 through 8 show another embodiment of the multi-reel apparatus 101 wherein the fabric 112 extends horizontally out from the top guide roll 127. FIG. 6 depicts completion of the parent roll 111 at the second reeling device 110'. FIG. 7 depicts kick-out of the completed parent roll 111 and core 109 replacement at the second reeling device 110' while winding of the new roll 111' continues at the first reeling device 110. FIG. 8 depicts engagement of the core 109 with the fabric 112 at the second reeling device 110' as winding of the parent roll 111 is completed at the first reeling device 110.

FIG. 9 shows an embodiment of the multi-reel apparatus 101 wherein the fabric run 128 is backward leaning. In this embodiment, the first and second reeling devices 110 and 110' are nearly vertically aligned. This cuts down on the horizontal space needed for the multi-reel apparatus 101. Note that the fabric run 128 could also be vertical or slightly forward leaning and still achieve near vertical alignment.

FIG. 10 presents an embodiment wherein the multi-reel 101 comprises an additional third reeling device 110". The first reeling device 110, the second reeling device 110' and the third reeling device 110" are all vertically stacked at different vertical levels. One advantage is that this allows greater cycle times for a given reeling device which allows more time for the kick-out and removal of parent rolls 111 and/or the placement of new cores 109. Another advantage is that maintenance could be performed on any one of the reeling devices 110, 110' and 110" while the others continue normal operation.

FIG. 11 schematically depicts another embodiment wherein the direction of travel of fabric 112 and paper web 108 has been reversed. In this embodiment, the upper or second reeling device 110' is upstream of the lower or first reeling device 110. FIG. 12 depicts another embodiment wherein a pre-existing drying section 102 has been retrofit to bypass a Yankee dryer 129 and substitute through-air drying. Note also that this embodiment includes a separate inner forming fabric 130 from which the web 108 is transferred onto the drying fabric 112.

FIG. 13 schematically depicts an embodiment wherein the TADs 104 are stacked instead of adjacent which reduces the footprint of the drying section 102. The top TAD 104 is an outward-flow unit indicated by the arrows 120. The paper web 108 through the top TAD is on the inside of the fabric 112, against the drying cylinder 118. The bottom TAD is an inward flow unit having the fabric 112 between the web and the drying cylinder 118.

FIG. 14 depicts an embodiment with a layout shortened by use of the backward leaning fabric run 128 for the multi-reel 101 similar to FIG. 9, but at a steeper angle, such that a part of the multi-reel is directly above the drying section 102. In this embodiment, the multi-reel apparatus 101 is located above and supported by the main floor 200. The TADs 104 are located below the main floor 200.

FIG. 15 depicts an embodiment using two outward flow TADs 104 that have their hoods 119 above, rather than below, the drying cylinders 118. This embodiment advantageously eliminates the requirement of space below the main floor 200. The forming section 132, the TADs 104 and the multi-reel apparatus 101 are all located above and supported by the main floor 200.

FIG. 16 depicts an embodiment with a combination of TADs 104 located below the main floor 200 and a Yankee dryer 129 located above the main floor. After being creped from the Yankee dryer 129, the web 108 is received by a support clothing 112' that carries the web through the multi-reel apparatus 101 which is located below the main floor 200.

FIG. 17 depicts a machine having two TADs 104 located below the main floor 200 and a Yankee dryer 129 located above the main floor performing a pre-drying operation. The final drying is performed by an additional TAD 104 whose drying fabric 112 carries the web through the multi-reel apparatus. The second reeling device 110' is also located above the main floor 200, while the first reeling device 110 is located below the main floor.

FIG. 18 depicts an embodiment wherein the web 10 is supported through the multi-reel apparatus 101 by a plurality of foils 131. FIG. 19 depicts an embodiment similar to that of FIG. 16 but having only a Yankee dryer for drying the web.

In another embodiment, the tissue paper web 108, which in many cases may be 5 to 6 meters in width, is cut in the middle prior to reel-up to create two small rolls 111A and 111B that are approximately half the original width of the paper web. Two separate, partial-width web portions 108A and 108B are simultaneously wound onto separate cores 109A and 109B, respectively, to form the small rolls 111A and 111B. In one embodiment, as shown in FIGS. 20A and 20B, the first reeling station includes a pair of small roll reeling devices 210 positioned at different vertical levels, and spaced in the cross-machine direction. The second reeling station includes another pair of small roll reeling devices 210' positioned in an arrangement similar to that of the first reeling station. The adjacent arrangement allows the simultaneous winding of the split web portions 108A and 108B in the same reeling station. Continuous winding is achieved by alternating between each pair of small roll reeling devices 210 and 210'.

In another split web embodiment, as shown in FIGS. 21A and 21B, the first reeling station includes two alternately operable reeling devices 210 for winding one of the partial-width web portions, and the second reeling station includes two alternately operable reeling devices 210' for winding the other web portion. The vertical stacking arrangement allows the simultaneous winding of the split web portions 108A and 108B in different reeling stations. Continuous winding is achieved by alternating between the small roll reeling devices of each pair of reeling devices 210, 210'. In general, smaller rolls are easier to handle in downstream operations than the heavier jumbo rolls. Nip loads are easier to handle with small rolls, contributing to the production of high-quality tissue paper. The smaller rolls also allow the use of composite based shaftless cores such as those described in commonly owned U.S. patent application Ser. No. 60/214,504 filed Jun. 28, 2000.

Note that additional embodiments of the present invention where the layout of the above-listed embodiments are inverted or in mirror image, are also possible. Although preferred for the manufacture of tissue paper webs, the multi-reel apparatus of the present invention could also be used with other paper grades.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multi-reel apparatus for winding a continuous travelling web onto each of a plurality of cores to form a plurality of rolls in a web manufacturing machine, comprising:

a web support that supports said travelling web along a path of travel that extends from a first vertical level to a second vertical level spaced vertically from the first vertical level;

vertically stacked first and second reeling stations located respectively at the first and second vertical levels, each reeling station having at least one reeling device operable to hold and rotatably drive a core onto which the web is wound to form a roll, and being further operable to move the core into engagement with the web on the web support to initiate reeling of the web onto the core, and to move the core away from the web support when the roll is fully wound so that the web can begin reeling onto the core held in another reeling device.

2. The multi-reel apparatus of claim 1, wherein the first and second reeling stations each have one reeling device whereby the web is continuously wound alternately in one reeling device of the first reeling station and then in the other reeling device of the second reeling station.

3. The multi-reel apparatus of claim 2, further comprising a cutting device operable to sever the web when the roll in one of the reeling stations is completed such that the other reeling station begins to wind the web onto the core.

4. The multi-reel apparatus of claim 2, wherein the web support comprises an endless clothing guided along the path of travel by a plurality of rolls about which the clothing is looped.

5. The multi-reel apparatus of claim 4, wherein the clothing is a through-air drying fabric.

6. The multi-reel apparatus of claim 2, wherein the web support comprises at least one foil.

7. The multi-reel apparatus of claim 2, further comprising an adhesive applicator positioned adjacent to the path of travel of the web upstream of the reeling stations and operable to apply adhesive to the web in response to a signal.

8. The multi-reel apparatus of claim 7, further comprising a cutting device positioned adjacent to the path of travel of the web and operable to cut the web downstream of the applied adhesive.

9. The multi-reel apparatus of claim 2, further comprising a third reeling station located at a third vertical level along the path of travel of the web.

10. The multi-reel apparatus of claim 2, wherein the web proceeds in a generally downward direction along the path of travel.

11. The multi-reel apparatus of claim 2, wherein the web proceeds in a generally upward direction along the path of travel.

12. The multi-reel apparatus of claim 1, wherein the continuous web prior to winding is divided into two partial-width web portions and wherein each reeling station includes two reeling devices for simultaneously winding the two web portions whereby the web is continuously wound alternately in the first reeling station and then in the second reeling station.

13. The multi-reel apparatus of claim 1, wherein the continuous web prior to winding is divided into first and second partial-width web portions respectively wound by the first and second reeling stations and wherein each reeling station includes first and second reeling devices that are vertically stacked and aligned in a width direction of the web, whereby each web portion is continuously wound alternately in the first and then the second reeling devices of each reeling station.

14. A paper web manufacturing machine, comprising:

a wet section having a former for forming a wet paper web;

a drying section for drying the wet paper web; and a multi-reel apparatus including a web support that supports the web along a path of travel that extends from a first vertical level to a second vertical level spaced vertically from the first vertical level and including vertically stacked first and second reeling stations located respectively at the first and second vertical levels, each reeling station having at least one reeling device operable to hold and rotatably drive a core onto which the web is wound to form a roll, and being further operable to move the core into engagement with the web on the web support to initiate reeling of the web onto the core, and to move the core away from the web support when the roll is fully wound so that the web can begin reeling onto the core held in another reeling device.

15. The machine of claim 14, wherein the first and second reeling stations each have one reeling device whereby the web is continuously wound alternately in one reeling device of the first reeling station and then in the other reeling device of the second reeling station.

16. The machine of claim 15, further comprising a cutting device operable to sever the web when the roll in one of the reeling stations is completed such that the other reeling station begins to wind the web onto the core.

17. The machine of claim 15, wherein the web support comprises an endless clothing guided along the path of travel by a plurality of rolls about which the clothing is looped.

18. The machine of claim 17, wherein the clothing is a through-air drying fabric.

19. The machine of claim 15, wherein the web support comprises at least one foil.

20. The machine of claim 15, further comprising an adhesive applicator positioned adjacent to the path of travel of the web upstream of the reeling stations and operable to apply adhesive to the web in response to a signal.

21. The machine of claim 20, further comprising a cutting device positioned adjacent to the path of travel of the web and operable to cut the web downstream of the applied adhesive.

22. The machine of claim 15, further comprising a third reeling station located at a third vertical level along the path of travel of the web.

23. The machine of claim 15, wherein the web proceeds in a generally downward direction along the path of travel.

24. The machine of claim 15, wherein the web proceeds in a generally upward direction along the path of travel.

25. The machine of claim 15, wherein the web support is a portion of a drying fabric on which the web is carried through at least part of the drying section.

26. The machine of claim 15, wherein the former is located above and supported by a main floor, the drying section includes at least one pre-dryer located below the main floor and a final dryer located above the main floor, and the web support comprises a drying fabric carrying the web through the final dryer, one of the reeling stations being located above and supported by the main floor and the other reeling station being located below the main floor.

27. The machine of claim 15, wherein the former is located above and supported by a main floor, the drying section includes at least one dryer located below the main floor and a dryer located above the main floor, and the web support comprises a drying fabric carrying the web through the reeling stations located below the main floor.

28. The machine of claim 15, wherein the former is located above and supported by a main floor, the drying section including at least one dryer located above the main floor, and the web support comprises a drying fabric carrying the web through the reeling stations located above and supported by the main floor.

29. The machine of claim 15, wherein the former is located above and supported by a main floor, the drying station including at least one dryer located below the main floor, and the web support comprises a drying fabric carrying the web through the reeling stations located above and supported by the main floor.

30. The machine of claim 15, wherein a portion of the multi-reel apparatus is positioned directly above the drying section.

31. The machine of claim 15, wherein the reeling stations are positioned in a near vertical alignment.

32. The machine of claim 14, wherein the continuous web prior to winding is divided into two partial-width web portions and wherein each reeling station includes two reeling devices for simultaneously winding the two web portions whereby the web is continuously wound alternately in the first reeling station and then in the second reeling station.

33. The machine of claim 14, wherein the continuous web prior to winding is divided into first and second partial-width web portions respectively wound by the first and second reeling stations and wherein each reeling station includes first and second reeling devices that are vertically stacked and aligned in a width direction of the web, whereby each web portion is continuously wound alternately in the first and then the second reeling devices of each reeling station.

34. A method for winding a continuous travelling web sequentially onto each of a plurality of cores to form a plurality of rolls in a web manufacturing machine, comprising the steps of:

advancing the web, supported on a web support, along a path of travel that passes adjacent to a first reeling station at a first vertical level and a second reeling station at a second vertical level;

holding and rotatably driving a core with a reeling device in each of the reeling stations;

moving the core held by the reeling device at the first reeling station into engagement with the web being directed by the web support;

winding the web onto the core held by the reeling device at the first reeling station and thereby forming a completed roll;

moving the core and completed roll away from the web support and out of engagement with the web with the reeling device at the first reeling station;

winding the web onto the core held by the reeling device at the second reeling station; and alternating between winding in the first and second reeling stations so that the web is continuously wound.

35. The method for winding a continuous travelling web as in claim 34, further comprising the step of severing the web when the roll in one of the reeling stations is completed such that the other reeling station begins to wind the web onto the core.

36. The method for winding a continuous travelling web as in claim 35, further comprising the step of applying adhesive to the web upstream of the reeling stations and in response to a signal.

37. The method for winding a continuous travelling web as in claim 34, wherein the advancing step further comprises advancing the web on an endless clothing guided along the path of travel by a plurality of rolls about which the clothing is looped.

38. The method for winding a continuous travelling web as in claim 37, wherein the advancing step comprises advancing the web on a through-air drying fabric.

39. The method for winding a continuous travelling web as in claim 34, wherein the advancing step comprises advancing the web on at least one foil.

40. The method for winding a continuous travelling web as in claim 34, wherein there is a third reeling station and said alternating step comprises alternating between the first, second and a third reeling stations.

41. The method for winding a continuous travelling web as in claim 34, wherein the advancing step comprises advancing the web in a generally downward direction along the path of travel.

42. The method for winding a continuous travelling web as in claim 34, wherein said advancing step comprises advancing the web in a generally upward direction along the path of travel.

43. A method for winding a continuous travelling web onto each of a plurality of cores to form a plurality of small rolls in a web manufacturing machine, comprising the steps of:

dividing the web into a pair of partial-width web portions;

advancing the web portions, supported on a web support, along a path of travel that passes adjacent to a first reeling station at a first vertical level and a second reeling station at a second vertical level vertically spaced from the first vertical level;

holding and rotatably driving a pair of cores with a pair of adjacent reeling devices in each of the reeling stations;

moving the cores held by the reeling devices at the first reeling station into engagement with the two web portions on the web support;

winding each web portion onto a respective one of the cores held by the reeling device at the first reeling station and thereby forming a pair of completed small rolls;

moving the cores and completed small rolls away from the web support and out of engagement with the web with the pair of reeling devices at the first reeling station;

winding the web onto the cores held by the reeling devices at the second reeling station; and alternating between winding in the first and second reeling stations so that the web is continuously wound.

44. A method for winding a continuous travelling web onto each of a plurality of cores to form a plurality of small rolls in a web manufacturing machine, comprising the steps of:

dividing the web into first and second partial-width web portions;

advancing the first web portion, supported on a web support, along a path of travel that passes adjacent to a first reeling station at a first vertical level and advancing the second web portion, supported on the web support, along a path of travel that passes adjacent to a second reeling station at a second vertical level vertically spaced from the first vertical level; and simultaneously winding the first web portion in the first reeling station and the second web portion in the second reeling station.

45. The method for winding a continuous travelling web as in claim 44, further comprising:

holding and rotatably driving a pair of cores with a pair of reeling devices vertically stacked in each of the reeling stations; and alternately winding the first web portion first in one then in the other of the reeling devices of the first reeling station, and alternately winding the second web portion first in one then in the other of the reeling devices of the second reeling station.

46. The method for winding a continuous travelling web as in claim 45, wherein the steps of alternately winding the web portions comprise:

moving one of the cores held in the reeling devices at each reeling station into engagement with the web portion being directed to that reeling station by the web support;

winding each web portion onto the one of the cores held by the reeling device at each reeling station and thereby forming a completed small roll;

moving the core and completed small roll away from the web support and out of engagement with the web;

winding the web onto the other one of the cores held by the reeling devices at each reeling station; and alternating between winding onto one core and then the other core of each reeling station so that the web is continuously wound.

47. A multi-reel apparatus for winding a continuous traveling web onto each of a plurality of cores to form a plurality of rolls in a web manufacturing machine, comprising:

a web support that supports said traveling web along a path of travel that extends from a first position to a second position, wherein said first and second positions are spaced from each other;

first and second reeling stations each having at least one reeling device operable to hold and rotatably drive a core onto which the web is wound to form a roll, the reeling device at the first reeling station being operable to move the core into engagement with the web on the web support at the first one of the positions, the reeling device at the second reeling station operable to move the core into engagement with the web on the web support at the second one of the positions, and each of the reeling devices being further operable to move the core away from the web support when the roll is fully wound so that the web can be continuously reeled by alternating the reeling devices.

48. A multi-reel apparatus of claim 47, wherein the first and second reeling stations each have one reeling device whereby the web is continuously wound alternately in one reeling device of the first reeling station and then in the other reeling device of the second reeling station.

* * * * *

UNITED STATES PATENT AND TRADEMARK OFFICE

CERTIFICATE OF CORRECTION

PATENT NO. : 6,709,549 B2
DATED : March 23, 2004
INVENTOR(S) : Berglund et al.

It is certified that error appears in the above-identified patent and that said Letters Patent is hereby corrected as shown below:

Column 9,
Lines 28-29, "U.S. application Ser. No. 60/214,504" should read -- U.S. patent application Ser. No. 60/214,507 --.

Signed and Sealed this

First Day of February, 2005

JON W. DUDAS
*Director of the United States Patent and Trademark Office*